US005990051A

United States Patent [19]

Ischy et al.

[11] Patent Number: 5,990,051

[45] Date of Patent: Nov. 23, 1999

[54] INJECTION MOLDED DEGRADABLE CASING PERFORATION BALL SEALERS

[75] Inventors: Noel David Ischy, Tyler; Craig Steven Fox, Rockwall, both of Tex.

[73] Assignee: Fairmount Minerals, Inc., Chardon, Ohio

[21] Appl. No.: 09/055,549

[22] Filed: Apr. 6, 1998

[51] Int. Cl.[6] ..... C09K 3/00; C09K 31/02; E21B 33/13

[52] U.S. Cl. ..... 507/204; 252/1; 166/294; 507/239; 507/219

[58] Field of Search ..... 252/1; 507/219, 507/239, 204; 166/294

[56] References Cited

U.S. PATENT DOCUMENTS

| | | | |
|---|---|---|---|
| 3,319,716 | 5/1967 | Dill | 166/42 |
| 3,971,852 | 7/1976 | Brenner et al. | 426/103 |
| 4,064,055 | 12/1977 | Carney | 507/130 X |
| 4,387,769 | 6/1983 | Erbstoesser et al. | 166/295 |
| 4,421,902 | 12/1983 | Chang et al. | 526/317 |
| 4,526,695 | 7/1985 | Erbstoesser et al. | 252/8.55 R |
| 4,552,909 | 11/1985 | Czerwinski et al. | 524/11 |
| 4,716,964 | 1/1988 | Erbstoesser et al. | 166/284 |
| 5,253,709 | 10/1993 | Kendrick et al. | 166/284 |
| 5,356,149 | 10/1994 | Kane | 273/218 |
| 5,374,486 | 12/1994 | Clatty et al. | 428/423.1 |
| 5,401,824 | 3/1995 | Clatty et al. | 528/53 |
| 5,500,020 | 3/1996 | Bandino | 8/94.22 |
| 5,684,114 | 11/1997 | Phillips et al. | 528/129 |
| 5,788,184 | 8/1998 | Eddy | 244/121 |

*Primary Examiner*—C. H. Kelly
*Attorney, Agent, or Firm*—C. W. Alworth

[57] ABSTRACT

A degradable ball sealer for use in the oil and gas industry is disclosed. The ball seat comprises a particular composition of matter and injection molding technique that provides a ball seal which will dissolve in stimulation or wellbore fluids after stimulation operations are complete. In use, the surface of the ball sealer softens slightly assuring a solid seal between the ball the and the casing perforation. The composition when dissolved into wellbore fluids does not pose a hazard and disperses well in aqueous based wellbore fluids. The same composition, made into a larger ball, may be used as a tubing sealer for pressure testing.

22 Claims, 11 Drawing Sheets

BIOBALLS - TEST INFORMATION

AVERAGE BALL: DIAMETER 0.91 INCH / SPECIFIC GRAVITY 1.2

** DISSOLUTION TEST **

THESE RESULTS WERE COMPILED ON 4 BALLS PLACED IN STATIC FLUIDS @ SPECIFIC TEMPERATURES FOR EXTENDED PERIODS AND DIAMETERS WERE MEASURED WITH A CALIPER.

BALL DIAMETER IN INCHES

| TIME | #1 H2O @ 72F | #2 H2O @ 120F | #3 15% HCL @ 72F | #4 15% HCL @ 120F |
|---|---|---|---|---|
| HOURS | | | | |
| 0 | 0.92 | 0.90 | 0.92 | 0.88 |
| 1 | 0.91 | 0.76 | 0.88 | 0.71 |
| 2 | 0.81 | 0.62 | 0.83 | 0.62 |
| 3 | 0.79 | 0.60 | 0.82 | 0.51 |
| 4 | 0.76 | 0.53 | 0.79 | 0.44 |
| 5 | 0.76 | 0.47 | 0.74 | 0.39 |
| 8 | 0.75 | 0.39 | 0.69 | 0.21 |
| 24 | 0.51 | 0.17 | 0.49 | 0.00 |
| 48 | 0.33 | 0.06 | 0.22 | 0.00 |

FIGURE 5

** PRESSURE TEST **

THESE RESULTS WERE COMPILED ON BALLS BEING MECHANICALLY TESTED TO 7000-8000 PSI AGAINST A 3/8" HOLE. IMMEDIATELY AFTER HEATING THE BALL TO A SPECIFIC TEMPERATURE IN H2O. FAILURE CONSTITUTES EXTRUDING OVER 3/8" OF BALL MATERIAL THROUGH THE 3/8" HOLE.

BALL SEALER TEST

| BALL # | TEMPERATURE ( DEGREES F ) | TEST TIME ( HRS ) | RESULT |
|---|---|---|---|
| 1 | 140 | 0.50 | HELD PRESSURE & SHAPE |
| 2 | 130 | 0.25 | HELD PRESSURE & SHAPE |
| 3 | 120 | 1.20 | HELD PRESSURE & SHAPE |
| 4 | 130 | 0.25 | HELD PRESSURE & SHAPE |
| 5 | 140 | 1.75 | HELD PRESSURE & EXTRUDED 5/16" INTO HOLE |
| 6 | 140 | 3.10 | HAILED TO HOLD PRESSURE & EXTRUDED THROUGH HOLE |
| 7 | 130 | 1.80 | HELD PRESSURE & SHAPE |
| 8 | 110 | 3.00 | HELD PRESSURE & SHAPE |
| 9 | 100 | 3.70 | HELD PRESSURE & SHAPE |

FIGURE 6

| | OPTIMUM RANGE | POSSIBLE RANGE |
|---|---|---|
| GLYCERIN | 0.2% - 8.0% | 0.1% - 31.7% |
| WINTERGREEN OIL | 0.1% - 10.0% | 0.1% - 26.4% |
| ZOLDINE | 0.1% - 9.1% | 0.1% - 19.1% |
| PROTEIN | 12.9% - 64.3% | 1.9% - 92.8% |
| OIL | 1.1% - 24.4% | 0.1% - 31.2% |
| WATER | 16.0% - 82.0% | 5.3% - 96.2% |

| MIXING TEMPERATURE | OPTIMUM RANGE | POSSIBLE RANGE |
|---|---|---|
| | 83 F - 173 F | 56 F - 214 F |

| MOLDING TEMPERATURE | OPTIMUM RANGE | POSSIBLE RANGE |
|---|---|---|
| | 83 F - 184 F | 67 F - 214 F |

FIGURE 7

INJECTION MOLDED DEGRADABLE CASING PERFORATION BALL SEALERS

TECHNICAL FIELD OF THE INVENTION

The instant invention relates to a degradable composition and method of manufacture for ball sealers which are used for temporarily sealing casing perforations and in particular relates to wellbore stimulation treatments in the oil and gas industry.

BACKGROUND OF THE INVENTION

Produced fluids (fluids are defined as liquids and gases) coming from a wellbore in the oil and gas industry are drawn from subterranean formations. The formation itself tends to restrict the flow of its own fluids, and the industry has defined a parameter which measures the tendency of fluids to flow under unequal pressure within a formation called permeability. Thus, the industry is interested in the permeability of a producing formation and employs techniques to maximize the permeability. There are several factors which affect the permeability of the formation which includes the effect of pores (the interstitial structure of the formation—namely voids, holes and other spaces), the effect of other fluids within the formation, and the effect of pore throats. Pore throats are essentially small pores within the formation.

After the actual drilling of a wellbore is complete, and if the well is successful, the industry performs an operation called completion. Completion is a series of involved operations and includes casing of the wellbore (running a steel tube from basically the bottom of the wellbore to the surface), cementing the casing in place within the wellbore (this operation fills voids between the steel casing and the formation strata and assures that one or more zones will not be in direct communication except through casing perforations), explosive perforation of the casing (punching holes through the steel tube and cement into the subterranean formation at the points where produced fluids are located), followed by cleaning and stimulation of the particular producing formation or formations.

Perforation involves the controlled explosive release of gases which are designed to penetrate the casing, penetrate any cement, and penetrate the subterranean formation immediately to next to the casing. The penetration into the formation is dependent on the size of the charge, the type of formation (sand, sandstone, etc.), the size and thickness of the casing, and myriad other parameters; thus, the perforation extending from the casing into the formation ranges from a couple of inches to several feet. The term "perforation " as used in the industry generally refers to the holes punched in the casing. It is assumed that the perforation operation will "punch" circular holes through the casing and cement into the formation. Most of the time this assumption is true; however, perforations can be irregular in shape.

After the perforation operation is complete, and as part of well completion the wellbore and the producing formation (or formations, in the case of multiple zones) must be cleaned and prepared for production. This series of operations are designed to remove remaining wellbore cuttings (the ground formation strata due to the drilling operation), remaining drilling fluids which are trapped behind the casing and in the production zone or zones, and stimulate the production by increasing the permeability. These operations are run from the surface and involve pumping various fluids, including acids, surfactants and other stimulation and cleaning fluids, down the wellbore into the production formation. The fluids will pass through perforations in the casing and into the formation. After a period of time, pressures are reduced so that the fluid will back-flow and draw impurities back into the wellbore and up to the surface. Sometimes the operator must pressure stimulate the producing zone (or zones) which requires pumping a fluid such as an acid, liquefied gas, a sand slurry, a viscous liquid, or another liquid into the wellbore under high pressure. The high pressure fluid flows through the casing and cement perforations and into the formation where the high pressure causes the formation to crack or fracture; hence, the name fracturing is used to describe this operation.

There is one substantial drawback in the initial cleaning and stimulation operations. The fluids will readily flow through the casing perforations and into the formation wherever the formation permeability is high. Thus, wherever the permeability is low, and treatment is a necessity, cleaning and stimulation fluids will not penetrate and extra pressure will be required to force the fluids into the formation. This extra pressure will in turn force additional fluids into zones which already have high permeability and could damage those zones by fracturing them. In the case of acid fracturing (a high pressure operation) the possibility of damage to production formation is substantially increased. Thus, a method for diverting, controlling or directing the flow of stimulation or cleaning fluids into the formation through casing perforations is required.

After the wellbore is placed in service and as the produced fluids flow through the formation, the produced fluids draw other materials along which often precipitate out (or just drop out) of the fluid. These materials will block the pores; thus, decreasing the permeability over time.

After a period of time, the operator of the wellbore must return to the site and retreat the formation to improve the permeability. These secondary stimulation treatments are similar to the initial treatments and generally include acids and surfactants, both of which are pumped into the wellbore and into the formation. During these secondary treatment operations, the areas of the formation where the permeability has decreased should be treated. Unfortunately, the treating fluids will flow most readily into the formation with the highest permeability—namely where the fluids are not needed, which is the same problem encountered during the initial treatment. In limited cases fracturing is again used and the danger of formation damage reappears. Thus, it is desirable to control or divert fluid flow into the regions with high permeability while forcing the fluids into regions of low permeability.

The industry has developed a product and method to control and direct treatment fluids through casing perforations and into the production zone or zones. The product is called a ball sealer: in reality a series of ball sealers which are capable of plugging the casing perforations. The ball sealers are slightly larger than the casing perforation and are capable of shutting off fluid flow through the casing perforation if and when they fall in front of a perforation. (The art is placing the sealers in the wellbore so that they will seal a perforation at the right time.) The associated method involves pumping the ball sealers into the wellbore along with the treatment fluids in an orderly manner so that they plug the offending perforation at the right time.

The standard method of use requires that the ball sealers be staged in the stimulation fluid as it is pumped into the wellbore. For example, assume that a simulation treatment requires 24 barrels (1,000 gallons) of fluid, and it is known that there are 24 perforations in the wellbore; thus 48 balls will be required. (The operator generally doubles the number of perforations to determine the number of balls.) In this example, the operator would release one ball for each one-half barrel pumped into the wellbore. This will help assure that each perforation is treated with an adequate amount of stimulation fluid before the next ball contacts the next perforation sealing it prior to increased fluid pressure breaking down (opening up) the next unsealed perforation and treating the formation associated with that perforation. The sequence of seal a perforation, treat the next, seal that perforation, treat the next, etc. continues until all the perforations have been ideally treated. At the surface, the operator will note a slight increase in pressure as one perforation is sealed and until the next formation opens up under pressure with an associated pressure decrease. The actual order of perforation treatment will not be from bottom to top, but will be associated with the order in which a given formation associated with a given perforation opens up. Ideally, at the end of the operation, all perforations seal and a sharp pressure increase is seen at the surface: this phenomena is called "balling out" and indicates that all perforations have been treated.

Once the initial or secondary operations are complete, the ball sealers fall away from the perforations (due to flow from the formation into the wellbore) and generally remain in the wellbore where they become a nuisance and present operational problems. Most wellbores contain a 'rat hole' which is an extension of the wellbore below the lower casing perforation about 20 plus feet in depth. (In some wellbores this rat hole can become filled with debris and no longer exists.) The balls fall into the rat hole, where, under some circumstances one may be picked up by the motion of the produced fluid and carried to surface. At the surface a renegade ball can plug the surface production valves creating a safety hazard. Some operators will place "ball catchers" at the surface to avoid this problem. Often the wellbore operator must reenter the hole with drilling tools and the excess balls surround the drilling pipe or downhole tools jamming the pipe or tools in the wellbore. This results in an expensive "fishing" operation to retrieve the jammed tools.

PRIOR ART

As stated above, ball sealers and the method of use have been known to and utilized by the industry for many years. The early ball sealers were usually made from a solid core with an outer coating made from rubber or a similar polymer coating. The core and coating were chosen so that the ball would be slightly buoyant in the stimulation fluid—be it acid or surfactant based. These balls were then added to the stimulation fluid at appropriate times during the stimulation operation and suspend themselves in the stimulation fluid. The balls are then carried down into the wellbore and plug off perforations which are in communication with high permeability strata; thus, diverting the stimulation fluid to perforations in communication with low permeability strata. The rubber/polymer coated ball sealers would remain in the wellbore and caused problems such as reported in the previous section.

The problems associated with the ball sealers remaining in wellbore have been addressed in a number of ways. One of the ways was to add a ball catcher at the surface; however, this solution did not address the problems caused by the balls when reentering a wellbore for certain drilling operations. U.S. Pat. No. 4,716,964 to Erbstoesser et al. discloses a method for using biodegradable ball sealers in a wellbore. The method patent is a continuation of a division of its U.S. Pat. No. 4,387,769 which disclosed a method for reducing the permeability of the actual formation during stimulation operations. The biodegradable ball sealer is disclosed in U.S. Pat. No. 4,526,695 which discloses and claims a biodegradable ball sealer. Erbstoesser discloses and claims a solid polymer ball sealer with the polymer being substantially insoluble in a stimulation fluid and degradable in the presence of water at elevated temperatures to oligomers which themselves are at least partially soluble in oil or water. Ball sealers following the Erbstoesser disclosure do not appear to be available on the market. The actual reason for lack of availability is not known; however, it is believed that the sealers using the Erbstoesser technology tend to break down too early or they cannot hold up under the stimulation pressures experienced in a wellbore. For example, if a ball sealer is extruded through a casing perforation into the formation, and/or cement seal lying immediately next to the casing, and if the compound will not readily breakdown in the wellbore fluid, that perforation will have problems. Erbstoesser (see U.S. Pat. No. 4,716,964) hints that such problems may occur with pressure differentials of 200 PSI and at temperatures in the range of 150 to 160 degrees Fahrenheit.

Kendrick et al. in U.S. Pat. No. 5,253,709 attempted to address the problem caused by irregular shaped perforations. Kendrick proposed a hard center ball with a deformable outer shell which would deform to the irregular shape of a casing perforation. The inner core is manufactured from binders and wax that is to melt at downhole temperatures; whereas the outer covering is a rubber. The ball would then pop loose from the casing perforation after a period of time; however, nothing is mentioned as to a degradable outer surface, and it would appear that the balls would remain intact in the wellbore.

There are other problems associated with the current generation of ball sealers. One of these problems is apparent in low pressure wells. After the well is treated using ball sealers, the formation pressure is insufficient to push the balls out of the casing perforations due to simple hydrostatic fluid pressure caused by the fluid head in the wellbore. If the balls do not readily break down a mechanical scrapper must be run down the wellbore or the well will not produce and the stimulation operation would be wasted.

Thus, there remains a need for an improved ball sealer (1) that is capable of diverting fluid flow from casing perforations which are in communication with highly permeable strata to perforations which are in communication with low permeability strata, (2) that will readily degrade in the stimulation fluid at the elevated temperatures found in wellbores but only after the stimulation process is complete, (3) that will degrade by becoming soluble in the fluids found in wellbores, (4) that is capable of deformation to conform to an irregular-shaped casing perforation, and (5) retain its strength and not extrude through a perforation casing while the stimulation process is underway.

SUMMARY OF THE INVENTION

The present invention relates generally to a composition of matter and method of manufacture used for degradable ball sealers to be utilized in the oil and gas industry. The present invention comprises an injection molded ball sealer comprised of a mixture of thermosetting adhesives and fillers which are soluble in water, surfactants and other aqueous based fluids found in most wellbores over a controlled period of time. For purposes of explanation, but not as a limitation, the filler material consists of glycerin, wintergreen oil, oxyzolidine oil, and water.

The ball sealer of the present invention is manufactured in a two step process. First a slurry comprising the preferred composition consisting of collagen and fillers is mixed and allowed to set up. The resulting composition is ground and sent to an injection molding device, using standard and known techniques, to be formed into balls having a diameter that is somewhat greater than the wellbore perforation. (Various diameters are produced but not usually exceeding 1.5 inches in diameter. This must not be read as a limitation, for if the balls are used to temporarily seal a production tubing, then the balls will have a greater diameter.) The ensuing balls will have a specific gravity in the range of 1.1 to 1.2. The specific gravity must not be read as a limitation for the specific gravity may be adjusted to fall in the range 0.5 to 2 depending on the mix of the composition used to manufacture the balls. Thus, the resulting ball comprises a round, solid, smooth surfaced seal ball with suitable characteristics that allow it to soften slightly on its surface in the presence of the stimulating fluid; thus, assuring a solid contact with the casing perforation, through controlled surface deformation, throughout the casing perforation. The core of the ball retains its strength until the stimulation operation is complete. Sometime after the operation is complete and certainly within a reasonable period of time, the balls will degrade and go into solution.

Thus the objects of this invention to provide a degradable ball sealer which will properly and completely seal casing perforations have been met. The ball sealers will break down in an aqueous fluid and therefore they can be used in a low pressure well, and the ball sealers could be used to temporarily plug the perforations during certain wellbore operations in which a wellbore fluid (e.g., mud) which is harmful to the producing formation is used. These and other objects and advantages of the present invention will become apparent to those skilled in the art after considering the detailed specification in which the preferred embodiments are described. In particular the use of the balls to seal production tubing for pressure testing.

BRIEF DESCRIPTION OF THE DRAWINGS

FIG. 5 gives the results of a dissolution test run on a series of ball sealers using the composition of the instant invention.

FIG. 6 gives the results of a pressure test run on a series of ball sealers using the composition of the instant invention.

FIG. 7 is a table listing the elements forming the composition of matter for the instant invention and showing both the possible range and the preferred range of the separate constituents for the composition of matter.

DESCRIPTION OF THE PREFERRED EMBODIMENT

Figure 1:
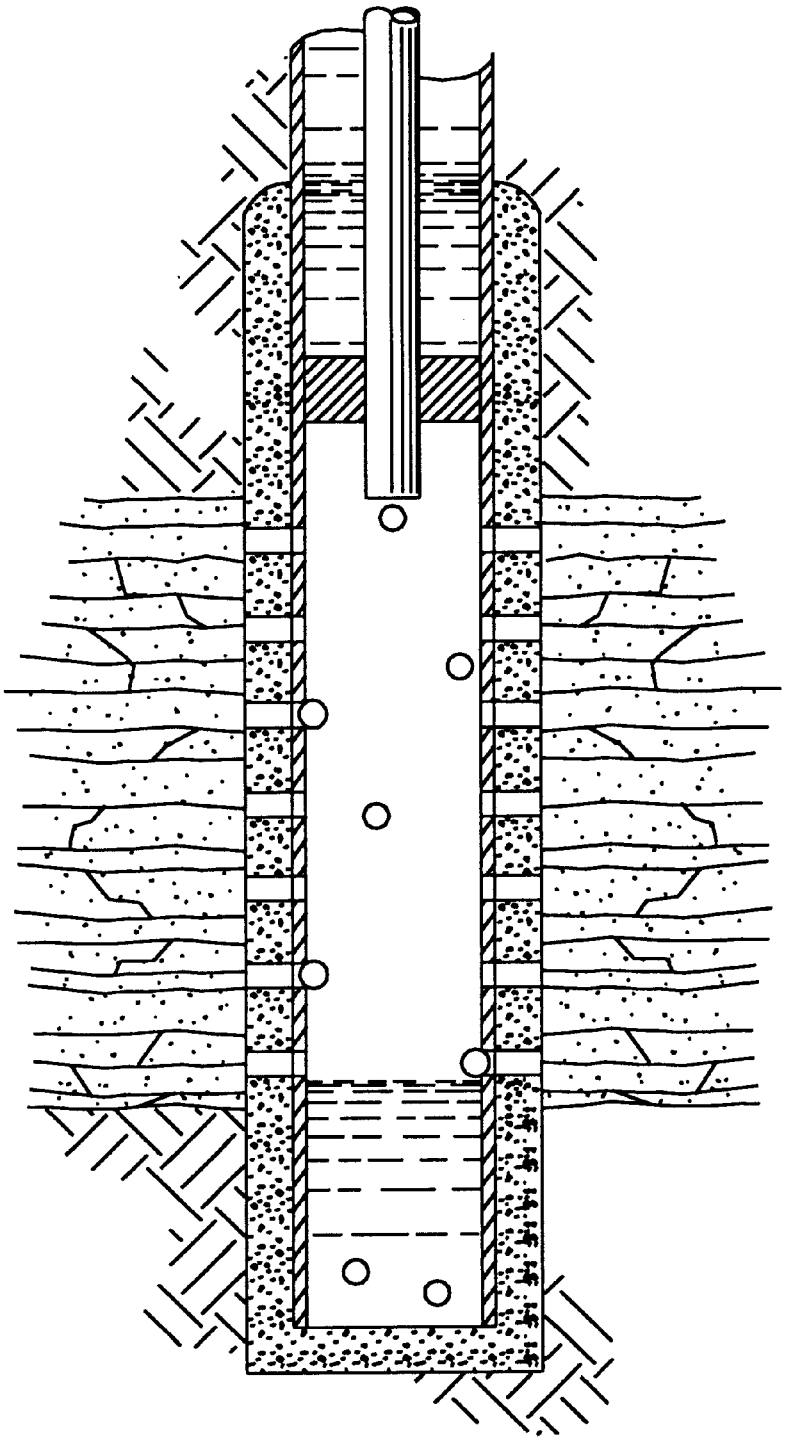
FIG. 1 is a diagrammatic sectional view of a wellbore showing perforations from the casing, through the cement and into the formation as well as illustrating the "rat hole", containing several ball sealers, at the bottom of the wellbore.

The preferred mixture to injection mold the ball sealer of the present invention comprises a soluble filler material and adhesives that when combined, and allowed to cure, will provide the required neutral mass and strength for ball sealer that forms the instant invention. For purposes of explanation, but not as a limitation, the filler material consists of glycerin, wintergreen oil, oxyzolidine oil (animal, vegetable or mineral), and water. The preferred oxyzolidine is ZOLDINE®, basically 5-HYDROYMETHYL-1-AZA-3,7-DIOXABICYCLO 93,3,0) OCTANE (55%) and WATER (45%). Other fillers may be added as needed and as explained later in this disclosure. The adhesive consists basically of collagen. The mixture is prepared by blending the collagen with the other elements in a proper ratio, as explained later in this disclosure, to form a viscous slurry suitable for injection molding. The mixture is thermosetting because of the combined properties of the constituents forming the composition of matter. Although not a part of the initial development, it is possible to add dyes at the time of mixing the slurry to indicate the specific gravity and/or the solubility time for the composition of matter forming the ball sealer. The prototype balls have a specific gravity in the range between 1.1 to 1.2 and ideally should have a specific gravity close to the fluid being used in the wellbore so that the balls will almost, but not quite, float in the wellbore fluid.

The viscous slurry must be carefully controlled for two reasons. First the dry slurry must have suitable properties for injection molding equipment, and second the composition of matter must, after injection molding and curing, exhibit the required properties expected of a ball sealer. It is known that glycerin and oil serve almost a similar function within the mixture. The oil (preferably mineral oil; however almost any heavy petroleum product or animal or vegetable oils may be used) serves to elongate the dissolution time when the ball is in the wellbore. Glycerin helps stabilize the ball during curing and can be replaced with oil.

The slurry is mixed in a carefully controlled temperature range varying between 56 to 214 degrees Fahrenheit and allowed to set up. The composition is then ground (a standard operation in the injection molding process) to a suitable size that allows the composition of matter to be fed to an injection molding machine containing a mold. The mold should have the form required for the particular ball size. Standard injection molding techniques are used, and any person who is skilled in the art of injection molding will be able to produce the balls; however, care must be taken in feeding the injection molding machine with the composition. It has been noted that relative humidity affects the operation, but a skilled operator can take the daily changes into account.

The mold will generally produce a plurality of balls and may be changed out to produce ball of various diameters. Standard mold manufacturing techniques are employed, and any person with skill in the art will be able to produce a suitable mold for an injection molding machine.

The mold temperature is held between 67 to 214 degrees Fahrenheit, and the injection pressure ranges between 100 to 2,000 PSI. (Those familiar with the art of injection molding know that pressure and injection temperature are interrelated. It is important to maintain the stated temperature range.) The temperature range is again dependent on relative humidity, and a skilled operator will be able to make the necessary adjustments. The formed ball(s) is(are) held within the mold cavity for a sufficient period of time to assure that thermosetting takes place. The mold is opened and the seal balls are removed and sent to storage for additional curing of at least two weeks. The actual curing time varies because the thermosetting composition will form a tight (few voids) surface about the ball itself; thus, limiting the rate that residual moisture can leave the body of the ball. The ball is fully cured when it will not distort or flatten under external pressure. Basically, a person can feel when the ball is cured, because finger nails will not penetrate the surface nor will the ball feel soft. Furthermore, when dropped, a properly cured ball will bounce like a marble.

Figure 2:
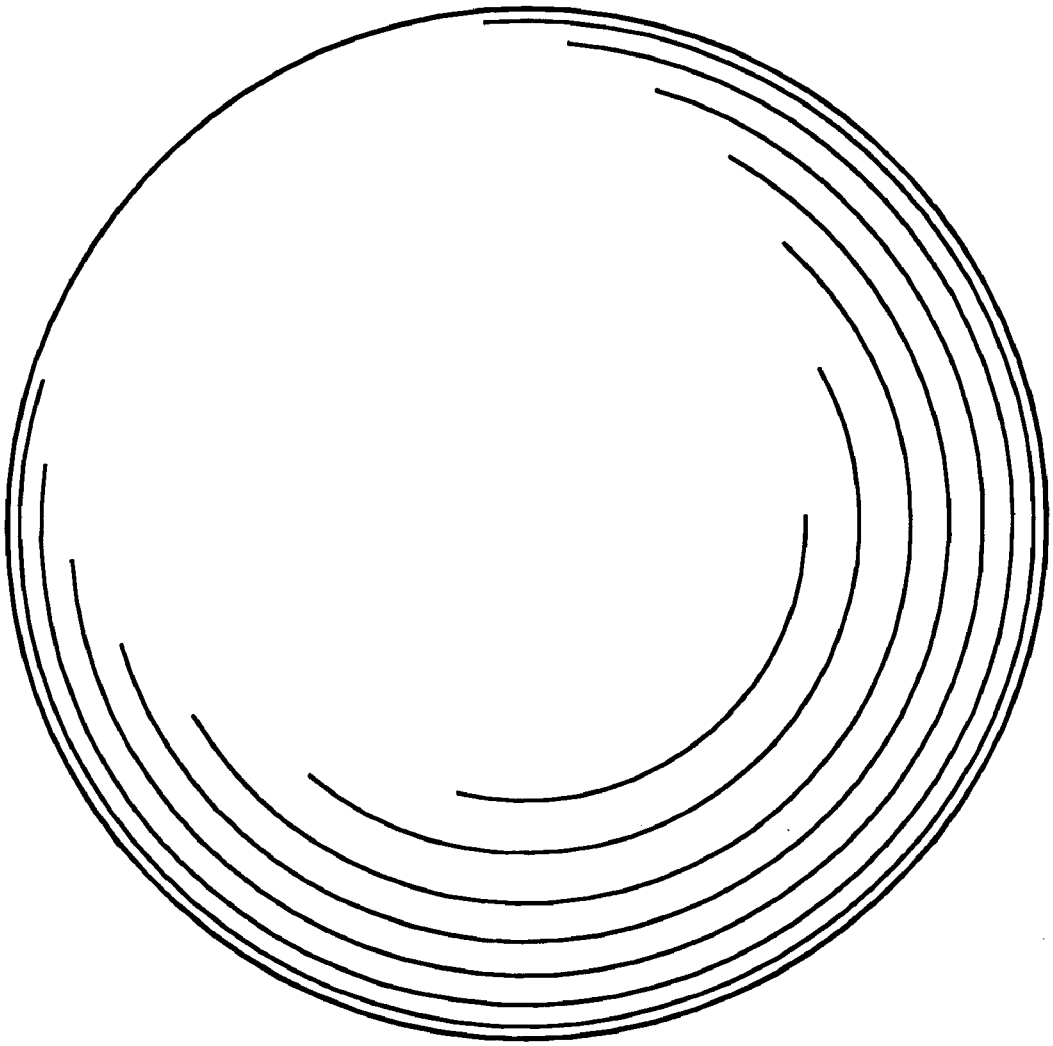
FIG. 2 is view of the instant injection molded invention.
Figure 3A:
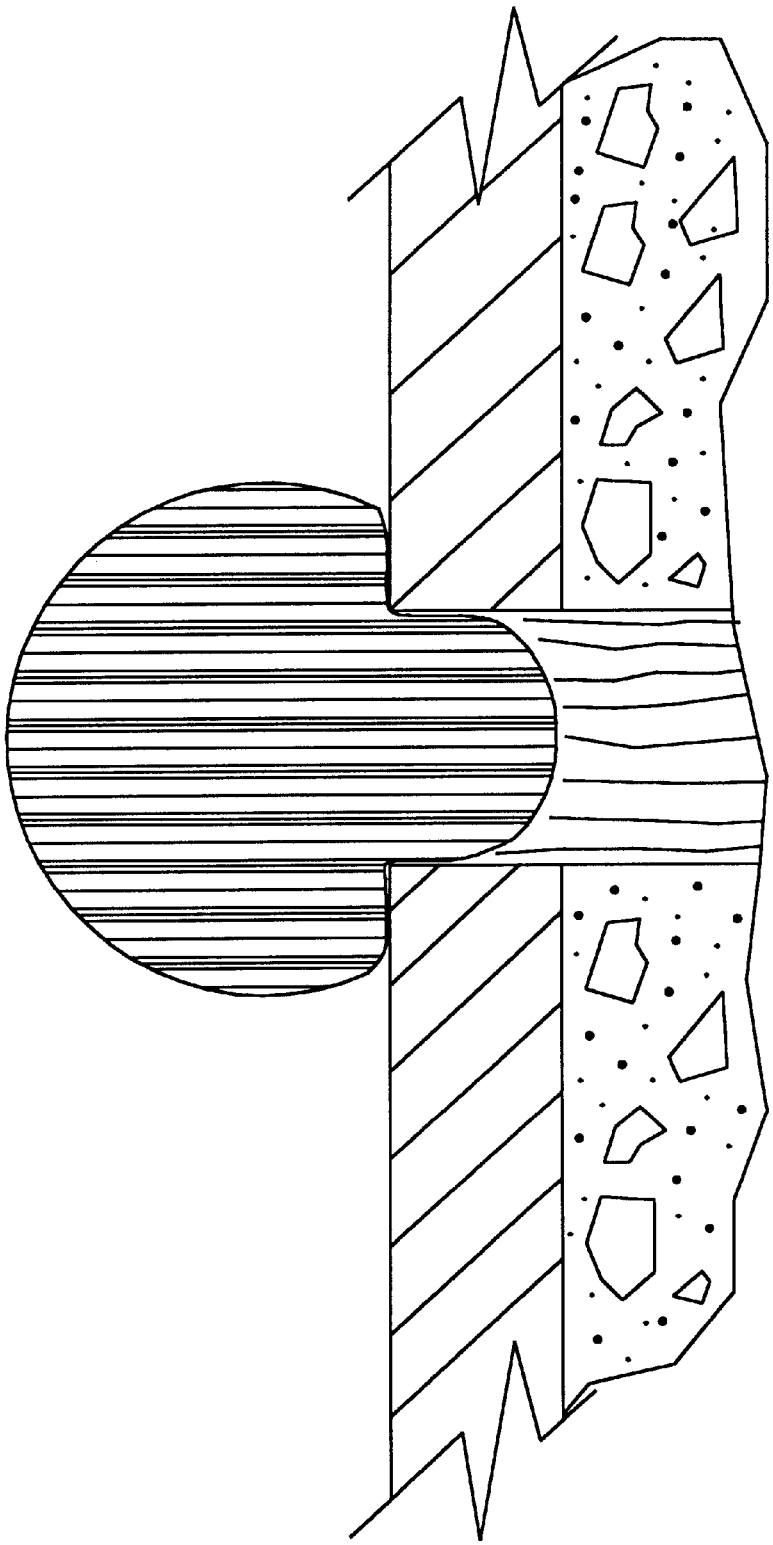
FIG. 3A shows a cross-sectional view of a ball sealer engaging a casing perforation.
Figure 3B:
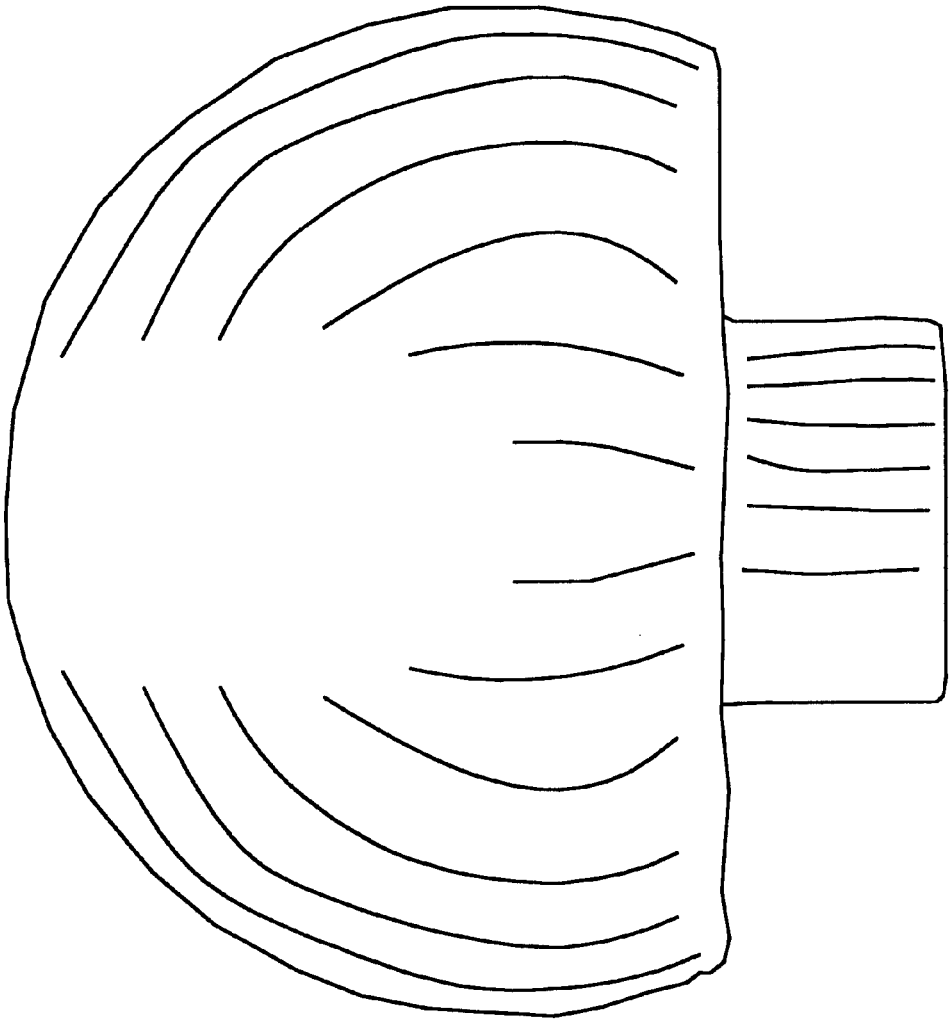
FIG. 3B shows a cross-sectional view of a ball sealer after engaging a casing perforation.
Figure 4:
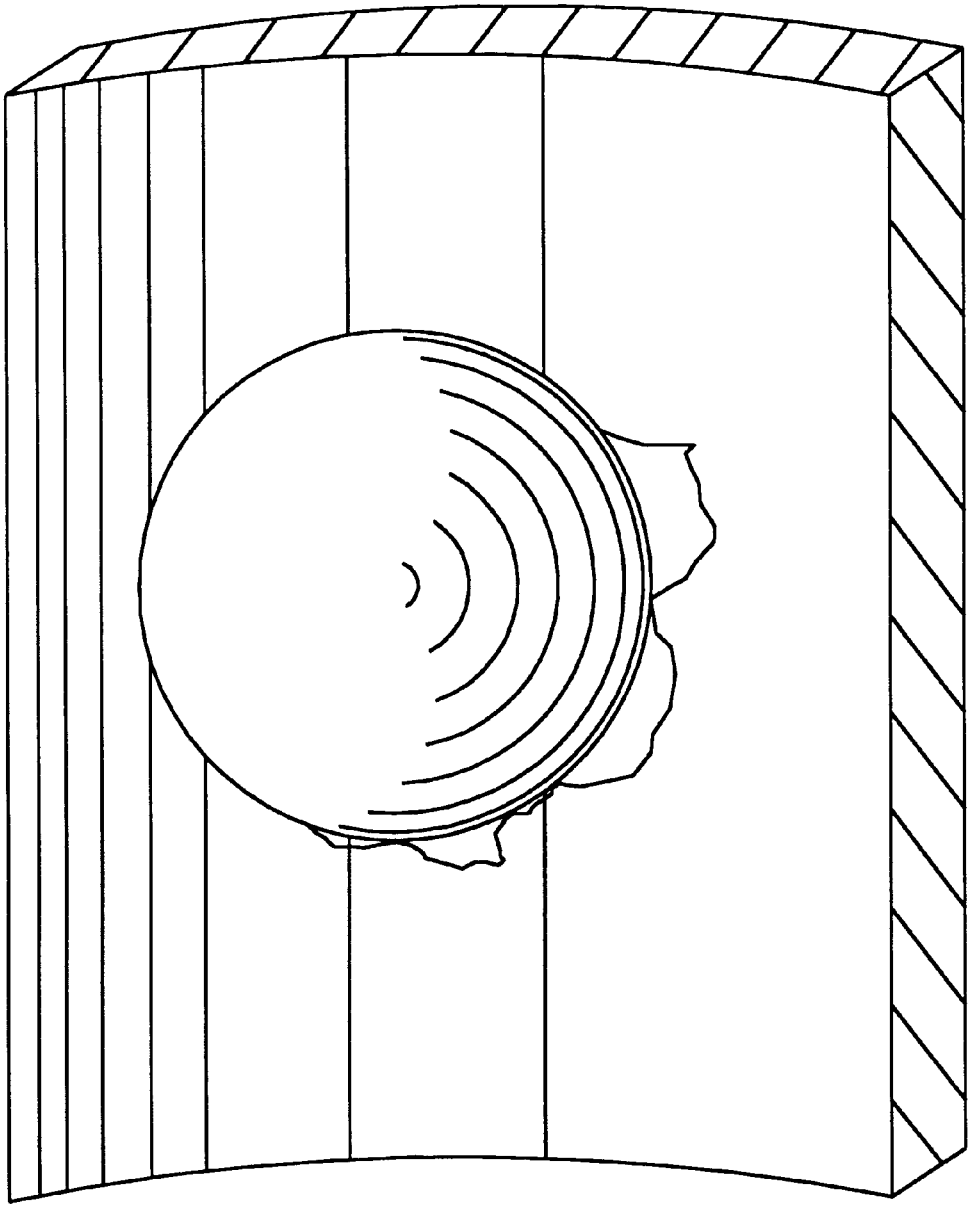
FIG. 4 shows a perspective view of an irregular-shaped perforation in the casing of a wellbore with a seal ball in place.

Upon completion of the process a plurality of degradable ball sealers having a mass between 0.25 to 1.25 ounces is produced. The diameter may be changed by changing the mold and should be chosen to meet the sealing condition that the ball perform under. (I.e., seal perforations or seal tubing.) The resulting ball (see FIG. 2) comprises a round, solid, smooth surfaced seal ball with suitable characteristics that allow it to soften slightly on its surface in the presence of the stimulating fluid; thus, assuring a solid contact, through controlled surface deformation, on the edges of the casing perforation. (See FIG. 3) The ball retains its strength until the stimulation operation is complete.

The optimum composition of matter—namely the dried slurry mixture sent to the injection molding operation—the mixing temperature, and the molding temperature were determined through a series of trial and error testing. For example, if the slurry is mixed at too low a temperature, it was found that the ingredients would not properly mix and a weak ball resulted. On the other hand if the slurry was mixed at a very high temperature, the collagen would break down which also resulted in a weak ball. The inventors define a "weak ball" to be one that will not hold up in a wellbore (see FIG. 1) when plugging a perforation.

Figure 9A:
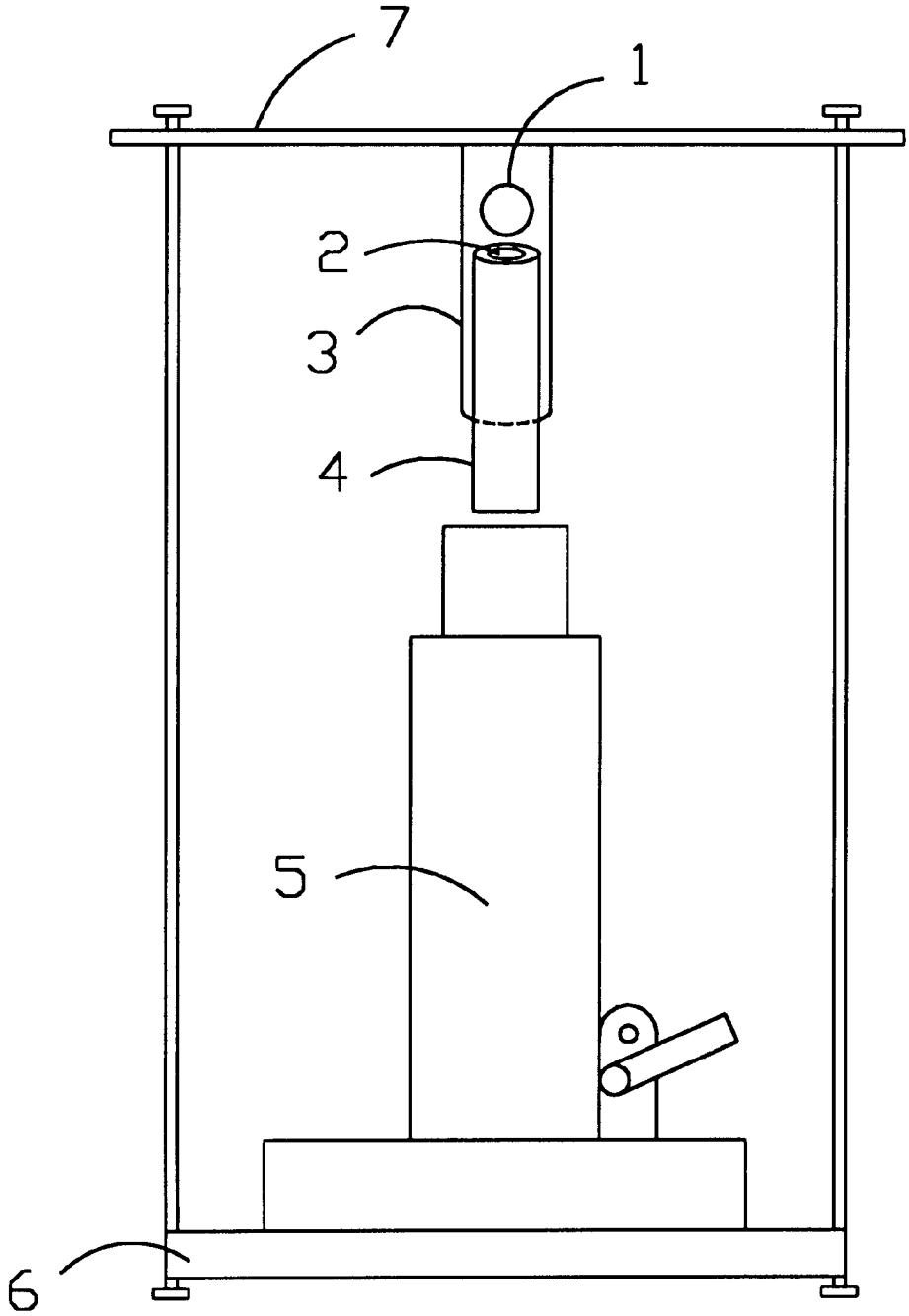
FIG. 9A is sketch of the one of the apparatuses used to "pressure-test" seal balls using the instant composition of matter.
Figure 9B:
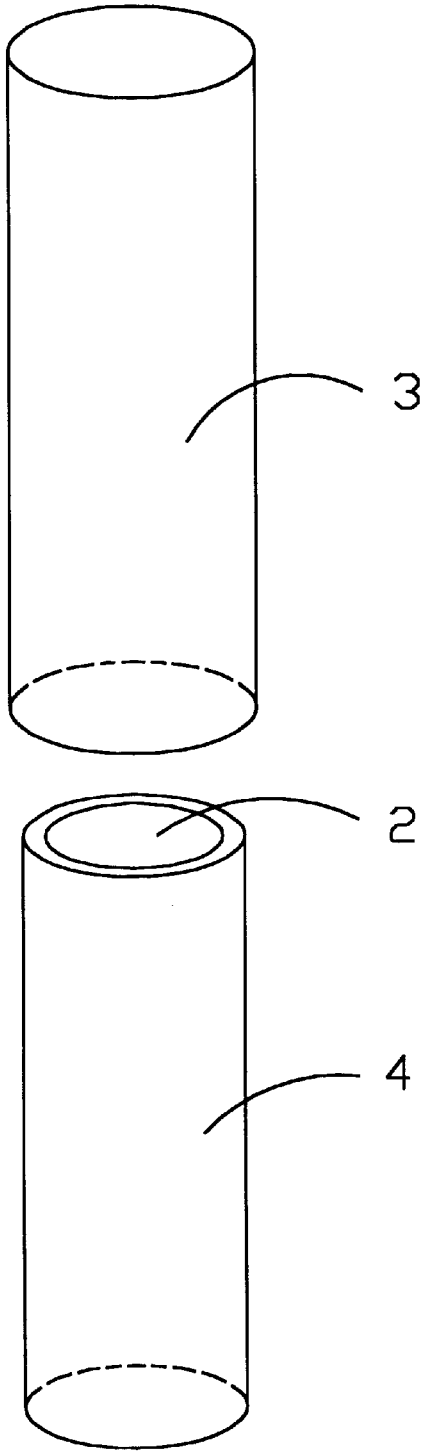
FIG. 9B is an expanded view of the test chamber.

Ball strength testing, or pressure testing, was performed in a pressure jig (see FIG. 9) which comprised a hydraulic jack, 5, pushing a seal ball, 1, contained within a steel conduit, 3, against a steel washer, 2, with a ⅜-inch hole. Other parts of the apparatus consisted of a base, 6, a top plate, 7, and a moving section, 4, which hold the washer, 2. Later a pressure jig which allowed technicians to place a liquid differential pressure across a plate containing a single ball that was plugging a single ⅜-inch diameter round hole was employed. A typical series of test runs is shown in FIG. 6. Other experiments show that the ball will fail (push through the washer) after extended times at temperatures higher than 120° F. However, actual wellbore testing showed that the wellbore fluid would be close to the surface temperature as long as the stimulation fluid was being pumped down the wellbore. In other words, the stimulation fluid itself cools and maintains the ball sealers.

The prototype balls were also subjected to dissolution testing in normal stimulation fluids. FIG. 5 shows the results of one of a series of tests. In the dissolution tests four balls were placed in stimulation fluid held at room temperature (approximately 72° F.) for a long time. The balls were removed from the fluid and the diameter measured with a caliper. The starting diameter for the balls was approximately 0.89 inches.

In actual use and when the stimulation process is complete, the wellbore temperature will return to the downhole ambient temperature. This increase in temperature that the ball sealers experience and their tendency to naturally go into solution in wellbore fluids will cause them to degrade and go into solution within several hours.

Figure 8:
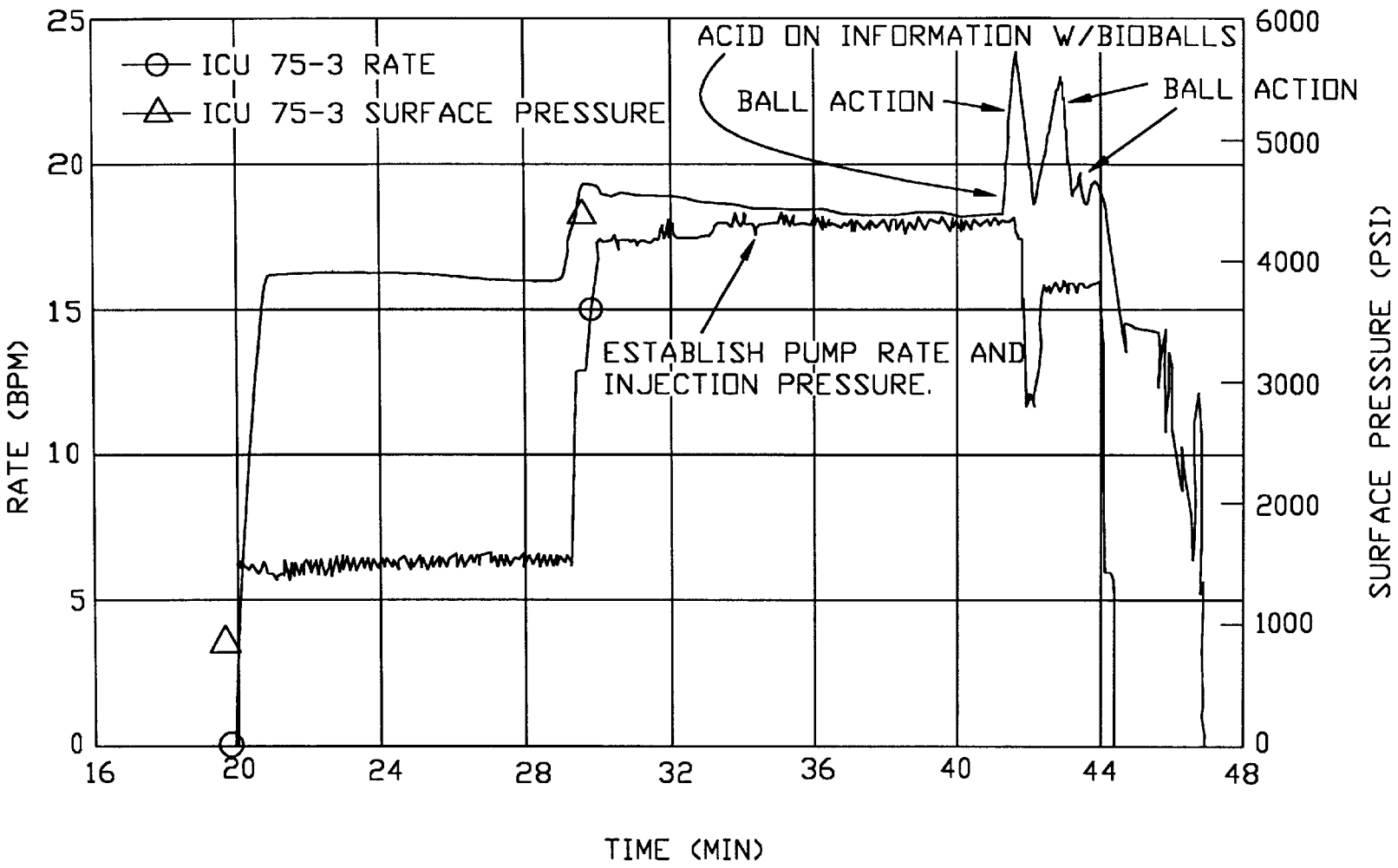
FIG. 8 is a copy of a chart made during the stimulation of a well showing the series of pressure changes and associated fluid flow that occur as the formation associated with a given perforation opens and is then sealed by a ball. Notations on the chart, made by the operator, show what is happening.

Actual field tests on a wellbore showed that ball sealers manufactured from the composition of matter disclosed held up to standard stimulation pressures for the duration of the stimulation process. (See FIG. 8.) It is not known exactly how much time was taken for the ball to completely degrade because one cannot "look" down a wellbore and make any measurements regarding the balls themselves. Based on test results and wellbore temperatures it was assumed that the balls went into solution after several hours. What was important—namely that the balls held pressures during the operation—was attained in the field tests.

The optimum mixture was determined by pressure testing (weakness) and dissolution testing. The optimum mixture is shown in FIG. 7. In a similar manner the optimum molding temperature was found by trial and error. The optimum temperature range is shown in FIG. 7. In the injection molding process, because injection pressure and mold temperature are interrelated, the injection process is run between 100 and 2000 PSI and the mold temperature is held to between 83 and 184 degrees Fahrenheit.

Laboratory testing showed that balls made with the composition of matter manufactured under the conditions given above will produce a ball sealer (1) that is capable of diverting fluid flow from casing perforations which are in communication with highly permeable strata to perforations which are in communication with low permeability strata, (2) that will readily degrade in the stimulation fluid at the elevated temperatures found in wellbores but only after the stimulation process is complete, (3) that will degrade by becoming soluble in the fluids found in wellbores, (4) that is capable of deformation to conform to an irregular-shaped casing perforation, and (5) that retains its strength and does not extrude through a perforation casing while the stimulation process is underway. Thus, ball sealers manufactured from the composition of matter and using the techniques disclosed meet the objectives of the disclosure.

The same ball sealers were used in multiple zone well, in which the production zone extended over 2000 feet. In the past, when this well was stimulated, the 2000 foot zone was divided into sections using "bridge plugs" to isolate one zone from another. A bridge plug is a device which is set in a wellbore and completely isolates one portion of the wellbore from another. The bridge plug can be removed by wire-line operations or by drilling it out. In a multiple zone well, the operator generally starts at the bottom of well and sets a packer above the zone to be stimulated. Stimulation operations for the lowest section then commence. Standard ball sealers are used with the fluid. Once the lower section is stimulated, a bridge plug is set at a point just below the next zone to be treated with the packer set just above the zone to be treated. Stimulation operations for this zone are then commenced. Standard balls are again used with the stimulating fluid. This process is repeated until the entire 2000 zone was treated. At the end of the stimulation process, the operator goes back in the well and drills out the bridge plugs. The operator often experiences a series of problems associated with the seal balls remaining in the wellbore. One operator in fact refuses to use ball sealers and bridge plugs because of the problems associated with the remaining seal balls. The operator attempts to stimulate a zone through high rate stimulation in the hopes that high fluid flow rate will open up low permeability section even though fluid is passing into other sections. The success is limited, but the operator does not have to contend with problems during the subsequent drilling operations.

The aforementioned operator was convinced to try seal balls using the instant composition. The usual method of setting bridge plugs, stimulating a section of the multiple zone, etc. was used. The seal balls performed exactly as expected—namely they held up to pressure for the required stimulation treatment time and degraded by the next day so that when the bridge plugs were drilled out, no problems were experienced. The operator was elated.

The prototype balls were manufactured with a specific gravity within the range 1.1 to 1.2. This range must not be read as a limitation for the composition of matter used to manufacture the balls may be adjusted to produce a range that falls within 0.5 to 2.0. The balls may be lightened by using a light weight filler such as pearlite. The balls may be made heavier by using a heavy weight filler such as sand. The filler elements that may be used to adjust specific gravity is limited only by the wellbore conditions and one's imagination. Wellbore conditions would limit the choice of filler because one would not want to use a filler that would or could damage the formation, add an unnecessarily hazardous material, etc. Finally, in wellbore operations a production tubing is often run from the surface to the production zone (or zones) and the tubing is isolated from the casing. It is often necessary to pressure test the tubing and a steel ball is allowed to travel to the bottom of the tubing where it will seal of the tubing. Pressure is then applied and the integrity of the tubing may be determined. Once this test is complete, the steel ball must be recovered. This is usually done by reverse flowing fluid down the casing and back up the production tubing while hoping that the ball will travel back to the surface. Often the ball stays in the tubing, which means that the entire string must be removed. A ball using manufactured from the instant composition of matter can easily be used in place of the steel ball. Pressure testing may be done and then time and temperature with degrade the ball; thus' opening up the tubing for production.

It is believed that the best and preferred embodiments of the instant invention have been described in the forgoing. While particular embodiments of the present invention have been described, it is apparent that changes and modifications may be made without departing from the instant invention in its broader aspects; therefore, the aim of the claims is to cover such changes and modifications as fall within the true spirit and scope of the invention.

We claim:

1. A method of manufacturing ball sealers which comprises the steps of:

a) mixing oxyzolidine, collagen, oil and water to form a mixture, and b) molding the mixture into round balls.

2. A composition of matter comprising a mixture of oxyzolidine, collagen, oil, glycerin and water.

3. The composition of matter in claim 2 further comprising wintergreen oil.

4. The composition of matter of claim 2 wherein the ranges of said individual constituents of the composition are oxyzolidine between 0.1 and 19.1 percent, collagen between 1.9 and 92.8 percent, oil 0.1 and 31.2 percent, water 5.3 and 96.2 percent, and glycerin 0.1 and 31.7 percent.

5. The composition of matter of claim 3 wherein the ranges of said individual constituents of the composition are oxyzolidine between 0.1 and 19.1 percent, collagen between 1.9 and 92.8 percent, oil 0.1 and 31.2 percent, water 5.3 and 96.2 percent, glycerin 0.1 and 31.7 percent, and wintergreen oil 0.1 and 31.7 percent.

6. The composition of matter of claim 4 wherein its constituents are mixed together within a temperature range falling between 56 degrees Fahrenheit and 214 degrees Fahrenheit.

7. The composition of matter of claim 5 wherein its constituents are mixed together within a temperature range falling between 56 degrees Fahrenheit and 214 degrees Fahrenheit.

8. The composition of matter of claim 2 wherein the ranges of said individual constituents of the composition are oxyzolidine between 0.1 and 9.1 percent, collagen between 12.9 and 64.3 percent, oil 1.1 and 24.4 percent, water 16.0 and 82.0 percent, and glycerin 0.2 and 8.0 percent.

9. The composition of matter of claim 3 wherein the ranges of said individual constituents of the composition are oxyzolidine between 0.1 and 9.1 percent, collagen between 12.9 and 64.3 percent, oil 1.1 and 24.4 percent, water 16.0 and 82.0 percent, glycerin 0.2 and 8.0 percent, and wintergreen oil 0.1 and 10.0 percent.

10. The composition of matter of claim 8 wherein its constituents are mixed together within a temperature range falling between 56 degrees Fahrenheit and 214 degrees Fahrenheit.

11. The composition of matter of claim 9 wherein its constituents are mixed together within a temperature range falling between 56 degrees Fahrenheit and 214 degrees Fahrenheit.

12. A method of manufacturing ball sealers which comprises the steps of:

a) taking oxyzolidine between 0.1 to 19.1 percent;

b) adding water between 5.3 and 96.2 percent;

c) adding oil between 0.1 and 31.2 percent;

d) adding collagen between 1.9 and 92.8 percent;

e) mixing components to form a compound; and, f) molding the compound into round balls.

13. The method of claim 12 wherein the following step is inserted between steps (e) and (f):

holding the mixing temperature between 56 degrees Fahrenheit and 214 degrees Fahrenheit.

14. A composition of matter comprising a mixture of oxyzolidine, collagen, oil, water, glycerin, and wintergreen oil.

15. The composition of matter of claim 14 wherein the ranges of said individual constituents of the composition are oxyzolidine between 0.1 and 19.1 percent, collagen between 1.9 and 92.8 percent, oil 0.1 and 31.2 percent, water 5.3 and 96.2 percent, glycerin 0.1 and 31.7 percent, and wintergreen oil 0.1 and 31.7 percent.

16. The composition of matter of claim 15 wherein its constituents are mixed together within a temperature range falling between 56 degrees Fahrenheit and 214 degrees Fahrenheit.

17. The composition of matter of claim 14 wherein the ranges of said individual constituents of the composition are oxyzolidine between 0.1 and 9.1 percent, collagen between 12.9 and 64.3 percent, oil 1.1 and 24.4 percent, water 16.0 and 82.0 percent, glycerin 0.2 and 8.0 percent, and wintergreen oil 0.1 and 10.0 percent.

18. The composition of matter of claim 17 wherein its constituents are mixed together within a temperature range falling between 56 degrees Fahrenheit and 214 degrees Fahrenheit.

19. A method of manufacturing ball sealers which comprises the steps of:

a) taking oxyzolidine between 0.1 to 9.1 percent;

b) adding water between 16.0 and 82.0 percent;

c) adding oil between 1.1 and 24.4 percent;

d) adding collagen between 12.9 and 64.3 percent;

e) mixing components to form a compound; and, f) molding the compound into round balls.

20. The method of claim 19 wherein the following step is inserted between steps (e) and (f):

holding the mixing temperature between 56 degrees Fahrenheit and 214 degrees Fahrenheit.

21. A composition of matter comprising a mixture of oxyzolidine, collagen, oil, water, glycerin, and wintergreen oil wherein the ranges of said individual constituents of the composition are oxyzolidine between 0.1 and 9.1 percent, collagen between 12.9 and 64.3 percent, oil 1.1 and 24.4 percent, water 16.0 and 82.0 percent, glycerin 0.2 and 8.0 percent, and wintergreen oil 0.1 and 10.0 percent and wherein said constituents are mixed together within a temperature range falling between 56 degrees Fahrenheit and 214 degrees Fahrenheit.

22. A composition of matter comprising a mixture of oxyzolidine, collagen, oil, water, glycerin, and wintergreen oil wherein the ranges of said individual constituents of the composition are oxyzolidine 0.3 percent, collagen 69.3 percent, oil 2.3 percent, water 25.4 percent, glycerin 2.3 percent, and wintergreen oil 0.4 percent and wherein said constituents are mixed together within a temperature range falling between 110 degrees Fahrenheit and 140 degrees Fahrenheit.

* * * * *